United States Patent [19]

Lo

[11] Patent Number: 5,035,553

[45] Date of Patent: Jul. 30, 1991

[54] DRILL BIT STORAGE RACK

[76] Inventor: Han-Chi Lo, 4th Fl., Lane 60, Min-Sheng Rd., Taoyuan, Taiwan

[21] Appl. No.: 547,189

[22] Filed: Jul. 3, 1990

[51] Int. Cl.[5] ..... B65D 85/20

[52] U.S. Cl. ..... 408/241 R; 206/379; 211/69

[58] Field of Search ..... 206/379; 211/69; 408/241 R

[56] References Cited

U.S. PATENT DOCUMENTS 4,909,386 3/1990 Jeffers ..... 211/69 X

FOREIGN PATENT DOCUMENTS 1215885 3/1986 U.S.S.R. ..... 408/241 R

*Primary Examiner*—Steven C. Bishop

*Attorney, Agent, or Firm*—Morton J. Rosenberg; David I. Klein

[57] ABSTRACT

The present invention provides for an improved drill bit storage rack having a housing with openings of differing diameters formed therein to accommodate drill bits of differing sizes. An outer cylindrical tube member adapted for insert into a housing opening is provided and is inserted into the housing opening in contiguous contact with the drill bit storage rack. A central interior cylindrical tube member is located within the outer cylindrical tube member and is rotatably displaceable with respect thereto. The central interior cylindrical tube member includes a through opening defining an interior wall having a pair of pin members extending inwardly with respect to the interior wall. A pair of opposing cylindrical tube members are secured within and to the outer cylindrical tube member on opposing sides of the central interior cylindrical tube member for rotatably capturing the central interior cylindrical tube member therebetween. In this manner, a drill bit having helical grooves is inserted within the outer cylindrical tube and the pin members are insertable within the helical grooves for guiding the drill bit to a predetermined position within the outer cylindrical tube.

1 Claim, 2 Drawing Sheets

DRILL BIT STORAGE RACK

BACKGROUND OF THE INVENTION

The present invention is directed to an improved structure for a drill bit storage rack wherein drill bits are inserted for storage between uses. The overall drill bit storage rack is provided with a guard which allows insertion of the drill bit to a certain location within the storage rack and protects the blade of the drill bit from being scratched or otherwise damaged.

Conventional and prior art drill bit storage racks are known in the art. Prior art storage racks provide generally for a housing having openings formed therein of differing diameter with the handle portion of a drill bit being inserted into one of the openings in accordance with the diameter or size of the drill bit being inserted. However, in such prior art drill bit storage racks, there are safety concerns due to the fact that by inserting the handle portion of the drill bit into the openings, the user is required to hold the blade portion of the drill bit in his or her hands. Through the use of such prior art drill bit storage racks, the user may cut his or her hand with the blade of the drill bit and additionally may be burned by the blade due to the high temperature of the blade after use.

It is believed that the above-referenced disadvantages of prior art drill bit storage racks are vitiated by the subject drill bit storage rack which overcomes the disadvantages by allowing the user to insert the drill bit by the handle portion of the drill bit and by the positionally locating the drill bit within the drill bit storage rack at a point where the blade does not interface with the drill bit rack housing to scratch or otherwise mutilate the blade itself.

SUMMARY OF THE INVENTION

A drill bit storage rack which includes a housing having openings formed therein. The drill bit storage rack openings have differing diameters to accomodate drill bits of differing size. At least one outer cylindrical tube member adapted for insert into at least one of the housing openings is in contiguous contact with the housing opening. The outer cylindrical tube member has a predetermined interior diameter defining a through opening. A central interior cylindrical tube member is included and has an external diameter substantially equal to the predetermined interior diameter of the outer cylindrical tube member. The central interior cylindrical tube member is rotatably displaceable with respect to the outer cylindrical tube member and further, the central interior cylindrical tube member includes a through opening defining an interior wall having a pair of pin members extending inwardly with respect to the interior wall. A pair of opposing cylindrical tube members are secured in fixed relation to the outer cylindrical tube member on opposing sides of the central interior cylindrical tube member for capturing the central interior cylindrical tube member therebetween. In this manner, a drill bit having helical grooves may be inserted within the outer cylindrical tube and the pin members are insertable within the helical grooves for guiding the drill bit to a predetermined position within the outer cylindrical tube responsive to a rotational displacement of the central interior cylindrical tube member.

It is an object of the subject invention to provide an improved drill bit storage rack which allows for the user to insert the drill bit into the drill bit storage rack by grasping the handle portion of the drill bit. In this manner, the user's hand is protected by holding the drill bit by the handle portion and not being either cut or burned by grasping the drill bit blade.

A still further object of the subject invention is to provide an improved storage rack where rotating pin members are insertable within helical grooves of the drill bit and guide the drill bit to a predetermined position within the drill bit storage rack and does not allow impact of the blade against any hard surface which would scratch the drill bit blade.

DESCRIPTION OF THE PREFERRED EMOBDIMENTS

Figure 3:
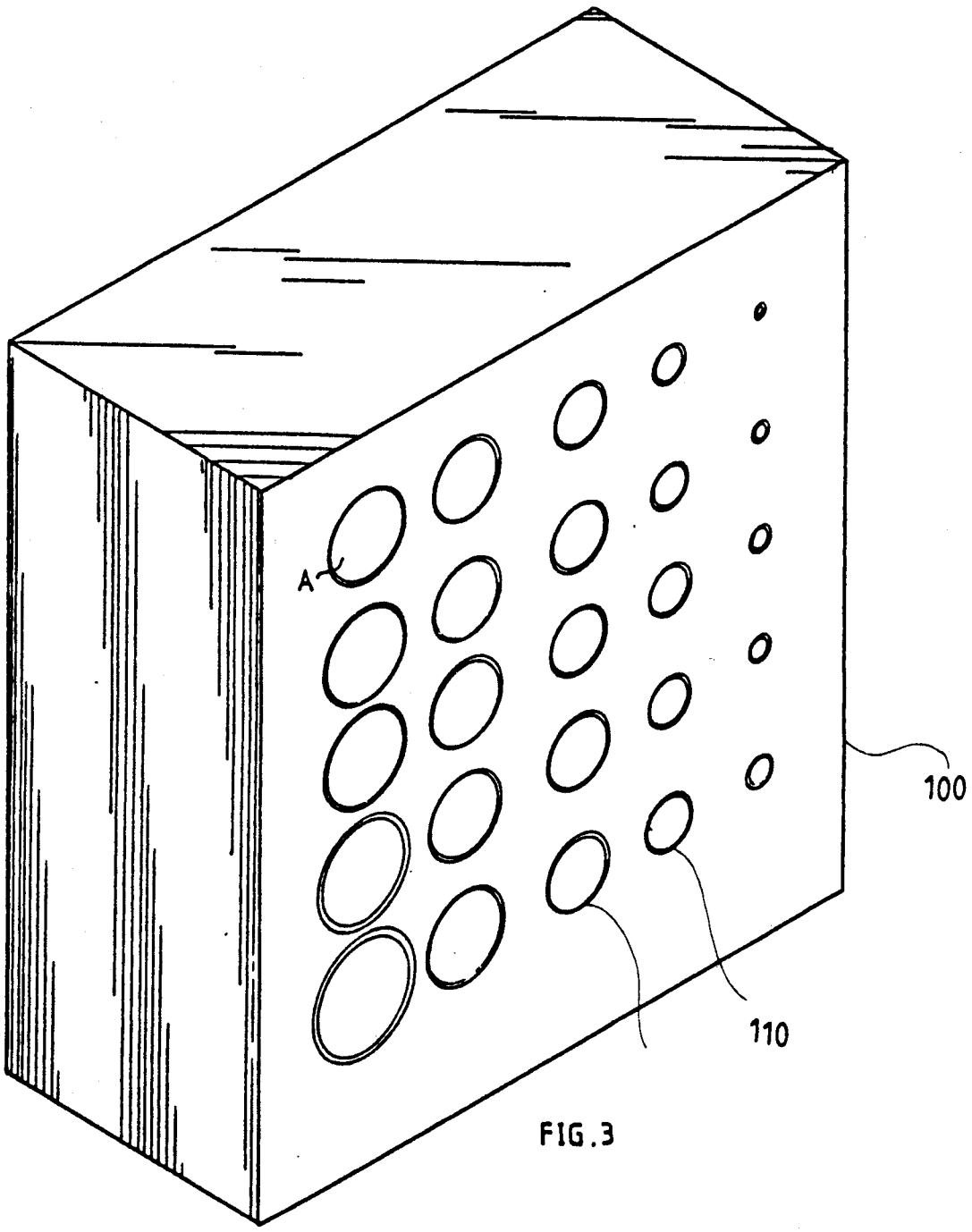
FIG. 3 is a perspective view of the drill bit storage rack.

Referring now to FIG. 3, there is shown drill bit storage rack 100 which includes a plurality of openings 110 for insert therein of drill bits. Openings 110 are of differing diameter dimensions for accommodating differing sized drill bits.

Figure 1:
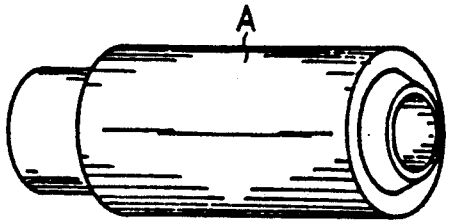
FIG. 1 is a perspective view of a drill bit guiding mechanism within which a drill bit is inserted.
Figure 2:
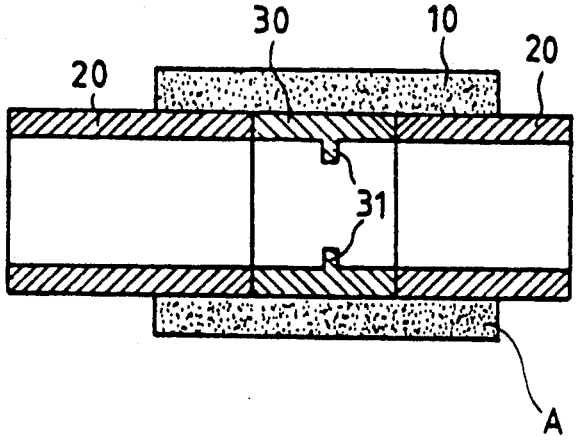
FIG. 2 is a cross-sectional view of the drill bit guiding mechanism.

Referring to FIG. 2, there is shown outer cylindrical tube member 30 of overall mechanism A which is insertable into at least one of the openings 110 of drill bit storage rack 100. Outer cylindrical tube member 30 includes a predetermined interior diameter defining a through opening, as is clearly shown in FIG. 2. Outer cylindrical tube member 30 is adapted for insert in at least a contiguous manner with one of the openings 110 of drill bit storage rack 100.

Mounted within outer cylindrical tube member 10 is central interior cylindrical tube 30 having an external diameter substantially equal to but slightly less than the predetermined interior diameter of outer cylindrical tube member 10. Central interior cylindrical tube member 30 is rotatably displaceable with respect to outer cylindrical tube member 10 and includes a through opening defining an interior wall having a pair of pin members 31 extending inwardly with respect to the interior wall and into the through opening of central interior cylindrical tube 30. Central interior cylindrical tube 30 is located substantially central the longitudinal extension of outer cylindrical tube member 10, however, such is not critical to the invention concept as herein described.

A pair of opposing cylindrical tube members 20 are mounted in fixed relation to outer cylindrical tube member 10 on opposing sides of central interior cylindrical tube 30 for capturing central interior cylindrical tube 30 therebetween. Central interior cylindrical tube 30 is rotatably displaceable with respect to opposing cylindrical tube members 20, as well as with respect to central interior cylindrical tube 30.

In this manner, a drill bit having helical grooves may be inserted within outer cylindrical tube member 10 with the pin members 30 being insertable within the helical grooves of the drill bit for guiding the drill bit to a predetermined position within outer cylindrical tube member 10 responsive to a rotational displacement of the central interior cylindrical tube member 30. Obviously, when the pin members 31 bear against an end portion of the drill bit helical grooves, no further insertion of the drill bit is provided and the blade of the drill bit may be maintained in a substantially fixed position within drill bit storage rack 100 without impinging the blade upon the back of the storage rack or otherwise interfacing with a surface which would scratch the drill bit blade.

I claim.

1. A drill bit storage rack comprising:

(a) a housing having openings formed therein, said openings having differing diameters to accommodate drill bits of differing diameters;

(b) at least one outer cylindrical tube member adapted for insert into at least one of said housing openings in contiguous contact therewith, said outer cylindrical tube member having a predetermined interior diameter defining a through opening;

(c) a central interior cylindrical tube member having an external diameter substantially equal to said predetermined interior diameter of said outer cylindrical tube member, said central interior cylindrical tube member being rotatably displaceable with respect to said outer cylindrical tube member, said central interior cylindrical tube member including a through opening defining an interior wall having a pair of pin members extending inwardly with respect to said interior wall; and, (d) a pair of opposing cylindrical tube members secured in fixed relation to said outer cylindrical tube member on opposing sides of said central interior cylindrical tube member for capturing said central interior cylindrical tube member therebetween, whereby a drill bit having helical grooves may be inserted within said outer cylindrical tube, said pin members being insertable within said helical grooves for guiding said drill bit to a predetermined position within said outer cylindrical tube responsive to a rotational displacement of said central interior cylindrical tube member.

* * * * *